US010920364B2

(12) United States Patent
Choi

(10) Patent No.: US 10,920,364 B2
(45) Date of Patent: Feb. 16, 2021

(54) REUSABLE FILTER CANISTER FOR A DRY-CLEANING MACHINE

(71) Applicant: Eung Chul Choi, Fair Oaks, CA (US)

(72) Inventor: Eung Chul Choi, Fair Oaks, CA (US)

( * ) Notice: Subject to any disclaimer, the term of this patent is extended or adjusted under 35 U.S.C. 154(b) by 110 days.

(21) Appl. No.: 16/237,658

(22) Filed: Dec. 31, 2018

(65) Prior Publication Data

US 2020/0208333 A1 Jul. 2, 2020

(51) Int. Cl.
*D06F 43/08* (2006.01)
*D06F 43/00* (2006.01)

(52) U.S. Cl.
CPC ..... *D06F 43/085* (2013.01); *D06F 43/007* (2013.01)

(58) Field of Classification Search
CPC ..... D06F 43/00–088; B01D 46/0002–0017
See application file for complete search history.

(56) References Cited

U.S. PATENT DOCUMENTS 3,156,647 A * 11/1964 Gould ..... D06F 43/085 210/209
3,730,347 A 5/1973 Giampalmi, Jr. et al.
3,836,005 A 9/1974 Bauer
4,138,337 A * 2/1979 Smith ..... B01D 29/58 210/238
4,266,412 A 5/1981 Merenda
4,793,938 A 12/1988 Dayton
5,015,375 A * 5/1991 Fleck ..... B01D 29/96 210/232
7,637,127 B2 12/2009 Mills et al.
2005/0262645 A1 12/2005 Yang et al.
2007/0095110 A1 5/2007 Naber et al.
2016/0243482 A1* 8/2016 Blaha ..... B01D 46/0019
2018/0340293 A1* 11/2018 Choi ..... D06L 1/10

OTHER PUBLICATIONS

Merriam-Webster. (n.d.). Strut. In Merriam-Webster.com dictionary. Retrieved Oct. 7, 2020, from https://www.merriam-webster.com/dictionary/strut (Year: 2020).*

* cited by examiner

*Primary Examiner* — Michael E Barr
*Assistant Examiner* — Omair Chaudhri
(74) *Attorney, Agent, or Firm* — Invent Capture, LLC; Samuel S. Cho

(57) ABSTRACT

A novel filter canister configured to dock into a dry-cleaning machine incorporates unique structural elements that reduce or eliminate debris overfill and jamming of the filter canister after an extended dry-cleaning operation. In particular, a novel perforated hollow inner core, a vertical strut-based canister docking frame, a washable and reusable cartridge with a perforated rigid inner surface layer and a particulate filtering element-encapsulating outer surface layer, and a removable lid that secures or frees the washable and reusable cartridge that constitute the novel filter canister enable a dry-cleaning operator to install, clean, and reuse the washable and reusable cartridge conveniently for numerous dry-cleaning cycles while avoiding debris overfill, canister jamming, and frequent filter canister replacement and repurchase needs that are endemic in conventional dry cleaner filter designs that tend to be cumbersome, costly, and environmentally detrimental.

7 Claims, 5 Drawing Sheets

A Frontal Perspective View of Another Embodiment of a Reusable Filter Canister for a Dry-Cleaning Machine

200

A Frontal Perspective View of an Embodiment of a Reusable Filter Canister for a Dry-Cleaning Machine

100

A Frontal Perspective View of Another Embodiment of a Reusable Filter Canister for a Dry-Cleaning Machine

200

An Open-Lid Top Perspective View of an Embodiment of a Reusable Filter Canister for a Dry-Cleaning Machine

300

A Perspective View of a Perforated Hollow Inner Core and Canister Docking Frame in an Embodiment of a Reusable Filter Canister for a Dry-Cleaning Machine

400

A Perspective View of a Washable and Reusable Cartridge with a Perforated Rigid Inner Surface Layer and a Particulate Filtering Element-Encapsulating Outer Surface Layer That Docks Into a Reusable Filter Canister

500

REUSABLE FILTER CANISTER FOR A DRY-CLEANING MACHINE

BACKGROUND OF THE INVENTION

The present invention generally relates to dry-cleaning machines and related components. In particular, the present invention relates to an environmentally-friendly reusable filter canister with uniquely-novel structural elements for improved operational maintenance, operator convenience, and dry-cleaner performance.

Conventional dry-cleaning machine operations widely utilized for wool, silk, and other hydro-sensitive garment cleaning are confronting increasingly tougher environmental standards, which in turn incur higher operating and regulatory expenses. In particular, a typical garment-cleaning service operation consumes various fabric-cleaning solvents and chemicals, which are becoming too costly for complying with ever-increasing environmental regulations. A "dry clean" process was invented in the mid-19$^{th}$ century and became a symbol of the commercial laundry industry. The dry clean process uses chemical agents instead of water and is effective in cleaning wool, silk, fur, and other fabric types which are difficult to clean with water. A first generation of dry cleaning methods generally used petrochemical solvents such as kerosene and even gasoline. Because kerosene and gasoline were found to be excessively flammable and outright dangerous for use in a commercial laundry facility, less flammable petrochemical agents such as a paraffin-derived "Stoddard solvent" were widely used until the 1950's.

The petrochemical solvents used in the first generation of dry cleaning were still frequently susceptible to fire and explosions, and a safer dry-cleaning solvent was need in the industry. Starting in the 1930's, tetrachloroethylene, also known as perchloroethylene or "perc" in short, was discovered to be a very effective and non-flammable dry-cleaning agent. Perc was also gentle to many sensitive garments such as silk and wool. The use of perc in dry cleaning became a defacto industry standard by the mid-20$^{th}$ century and still is a common choice for dry cleaning operations.

However, in the 1990's, tetrachloroethylene was declared to be a carcinogen against humans and a contaminating agent on the Earth's atmosphere. For example, in 1993, the California Air Resources Board devised an airborne toxic control measure to reduce perc emissions from commercial laundry facilities. Many commercial laundry facilities today face strict environmental standard restrictions and even a general phase-out of perc-based dry cleaning machines. Although more eco-friendly chemical agents such as glycol ethers and decamethylcyclopentasiloxane (D5) were devised, increasingly stringent environmental regulations against any chemical dry-cleaning agents and a high cost of operation and equipment have prevented the commercial laundry industry from rapidly adopting such eco-friendly alternatives.

In a conventional dry-cleaning operation, a periodic replacement of a used dry-clean filter unit with a brand-new unit is a costly yet widely-accepted practice to reduce particulate overfill, perc overflow, and/or undesirable odors associated with the used dry-clean filter. A standard operating procedure in the commercial dry-cleaning industry involves a dry-cleaning service operator purchasing an all-new filter unit embedded in a specialized new casing, and swapping the specialized new casing with the old casing currently installed in a dry-cleaning machine. Both dry-cleaning machine manufacturers and filter unit manufacturers discourage dry-cleaning service operators from taking a filter casing apart in an attempt to clean and reuse the inside of the filter casing, because dust, particulate, and chemical accumulation in a conventional filter casing tends to jam-pack the interior of the casing badly, which makes an amateur disassembly of the casing difficult, dangerous, and unsanitary from the operational and environmental standpoint.

Typically, the conventional filter casing is a factory-sealed product, which is not designed to be ever opened up or disassembled by a dry cleaner operator. Replacing such conventional filter casings can become quite costly for the dry cleaner operator, as the factory-sealed filter casing is not cleanable or reusable after the casing is filled up with dust, debris, and dirty chemical residue.

Therefore, it may be desirable to devise a novel reusable filter canister for a dry-cleaning machine that can be repeatedly dusted out to a trash container and/or cleaned with a power wash for a prolonged operational lifecycle, compared to a conventional factory-sealed filter design. Furthermore, it may also be desirable to devise a novel reusable filter canister for a dry-cleaning machine that incorporates unique structures to prevent or reduce particle, debris, and chemical residue overfill or jampacking within the canister that can make disassembly and cleaning unpleasant and difficult for a dry-cleaning operator.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a reusable filter canister for a dry-cleaning machine is disclosed. This reusable filter canister comprises: a vertical strut-based canister docking frame with a base plate; a perforated and cylindrical hollow inner core erected perpendicularly near a center of the base plate of the vertical strut-based canister docking frame, wherein the perforated hollow cylindrical inner core incorporates a plurality of micro-holes on its lateral surface; a vertical strut erected perpendicularly from a boundary of the base plate of the vertical strut-based canister docking frame; a washable and reusable cylindrical cartridge comprising a perforated rigid inner surface layer and a particulate filtering element-encapsulating outer surface layer, wherein the washable and reusable cylindrical cartridge is configured to be docked into or removed from the vertical strut-based canister docking frame with the base plate, wherein a bottom outer boundary of the washable and reusable cylindrical cartridge, when docked into the vertical strut-based canister docking frame, is enclosed by the base plate; a removable lid with a center opening that aligns with a top portion of the perforated and cylindrical hollow inner core, wherein the removable lid is configured to enclose a top outer boundary of the washable and reusable cylindrical cartridge; and a lid clamp attached to a top portion of the vertical strut, wherein the lid clamp is configured to bind the vertical strut-based canister docking frame, the washable and reusable cylindrical cartridge, and the removable lid tightly when the washable and reusable cylindrical cartridge is docked into the vertical strut-based canister docking frame.

DETAILED DESCRIPTION

Figure 1:
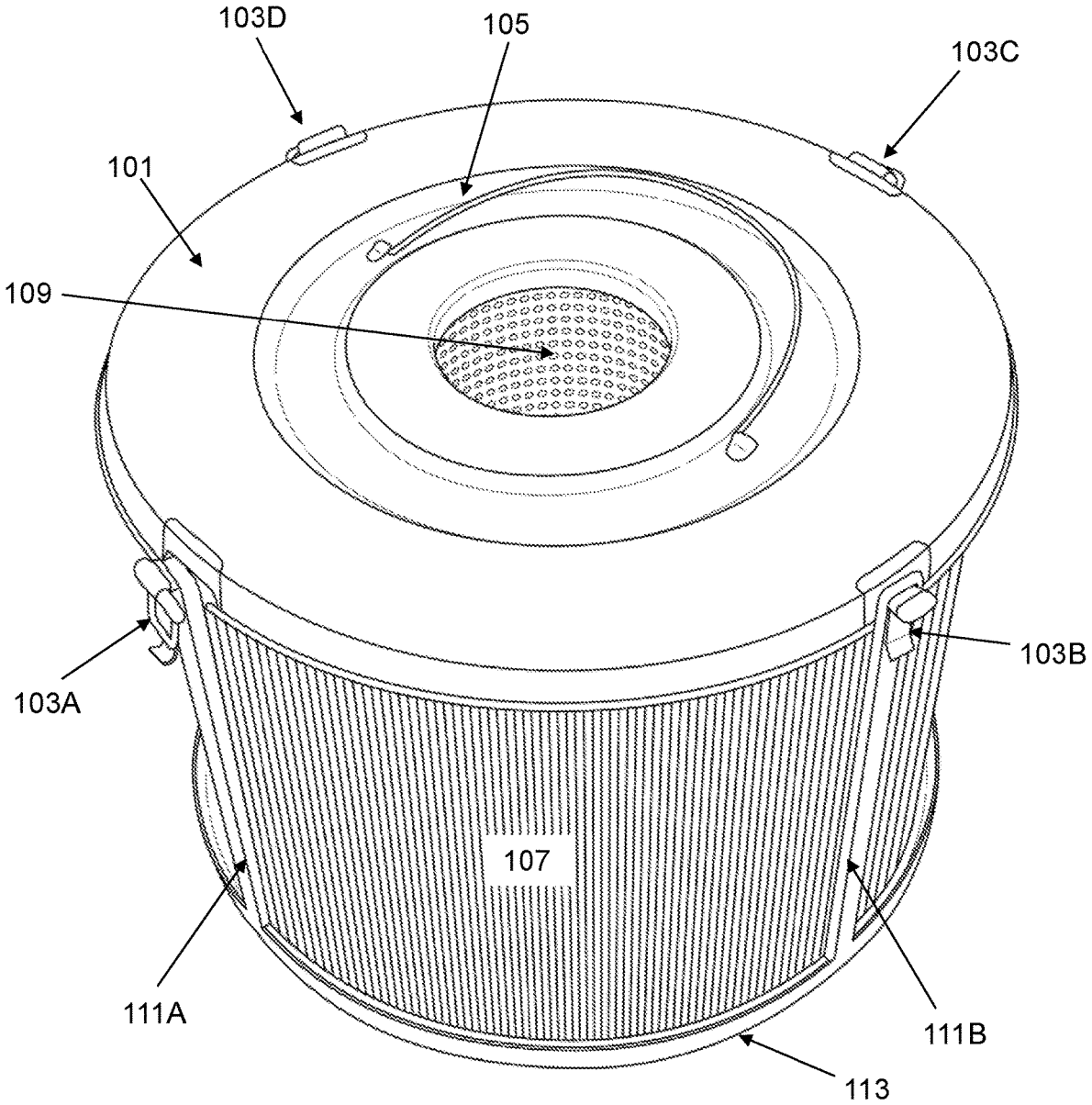
FIG. 1 shows a frontal perspective view of an embodiment of a reusable filter canister for a dry-cleaning machine, in accordance of an embodiment of the invention.

Specific embodiments of the invention will now be described in detail with reference to the accompanying figures. Like elements in the various figures are denoted by like reference numerals for consistency.

In the following detailed description of the present invention, numerous specific details are set forth in order to provide a thorough understanding of the present invention. However, it will become obvious to those skilled in the art that the present invention may be practiced without these specific details. In other instances, well known methods, procedures, and/or components have not been described in detail to avoid unnecessarily obscuring aspects of the present invention. The detailed description is presented largely in terms of procedures, logic blocks, processing, and/or other symbolic representations that directly or indirectly resemble a reusable filter canister for a dry-cleaning machine and/or a washable and reusable cartridge configured to dock into the reusable filter canister. These descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

This invention generally relates to dry-cleaning machine filters. More specifically, the present invention relates to a uniquely-structured and novel reusable filter canister for environmentally-friendly and cost-efficient commercial dry cleaning operations. The present invention also relates to a novel washable and reusable cartridge configured to dock into and retract from a canister docking frame of the uniquely-structured and novel reusable filter canister.

Figure 3:
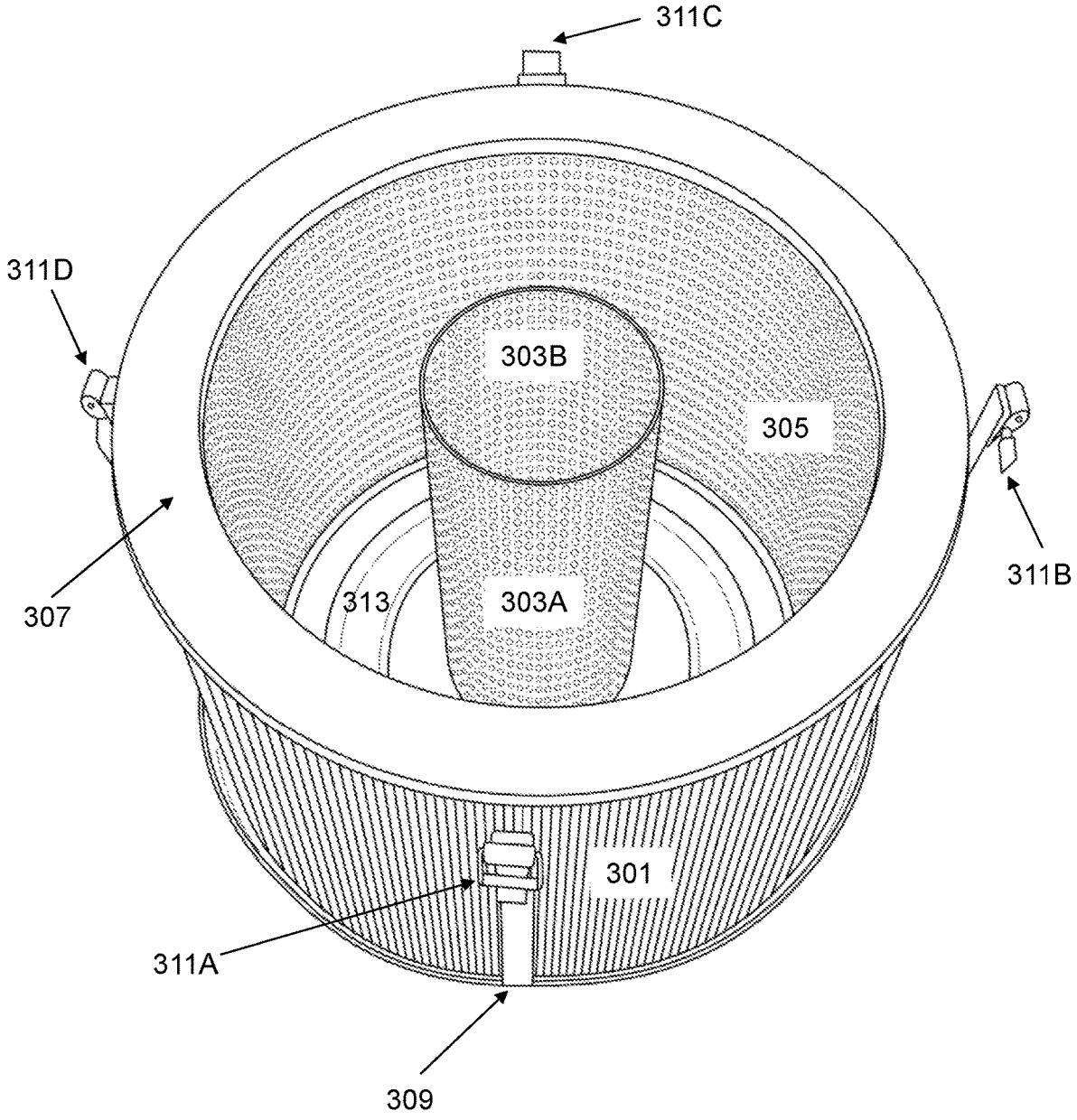
FIG. 3 shows an open-lid top perspective view of an embodiment of a reusable filter canister for a dry-cleaning machine, in accordance with an embodiment of the invention.
Figure 4:
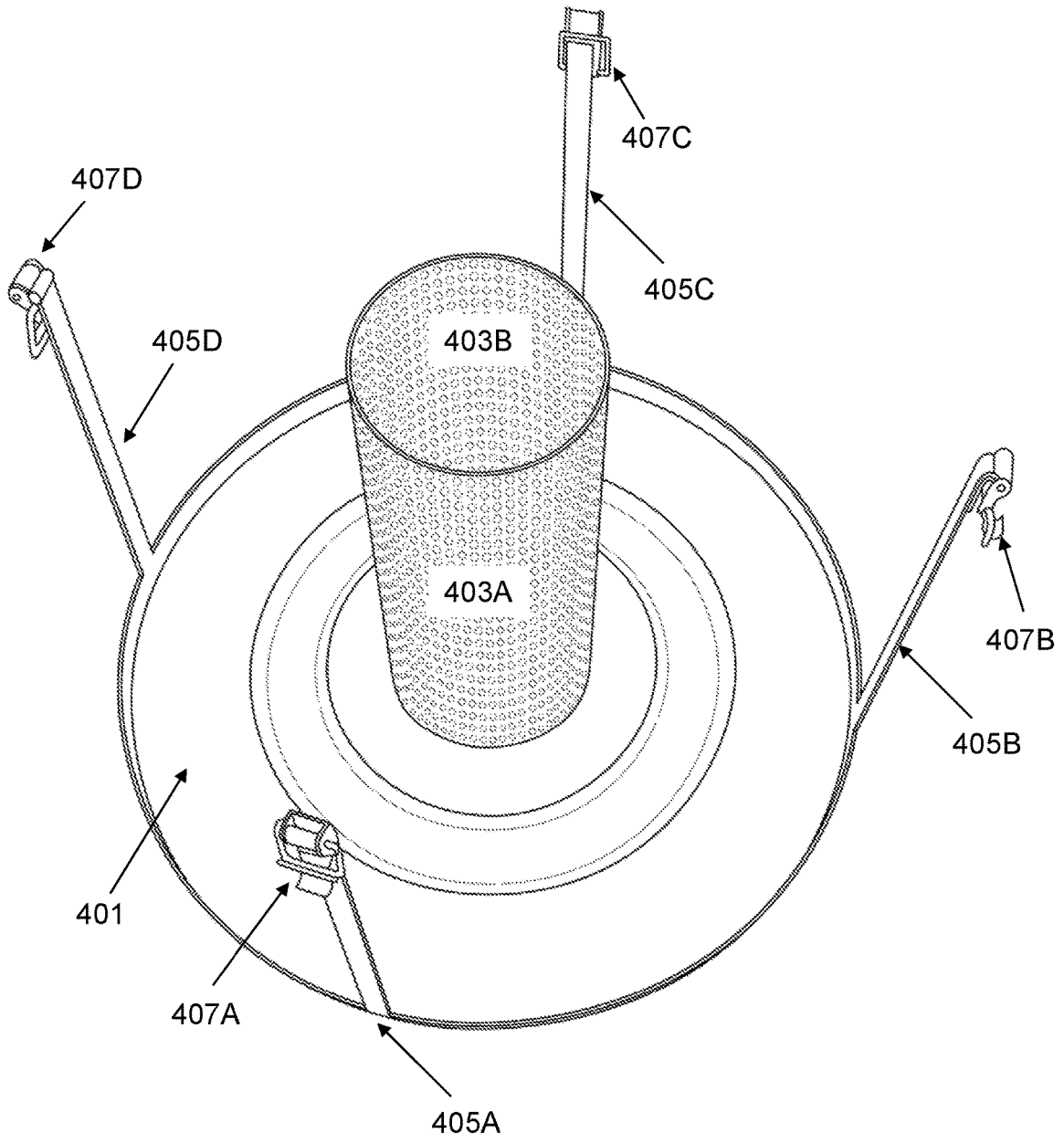
FIG. 4 shows a perspective view of a perforated hollow inner core and canister docking frame in an embodiment of a reusable filter canister for a dry-cleaning machine, in accordance with an embodiment of the invention.

FIG. 1 shows a frontal perspective view of an embodiment of a reusable filter canister (100) for a dry-cleaning machine, in accordance of an embodiment of the invention. In a preferred embodiment of the invention, the reusable filter canister (100) is made of a vertical strut-based canister docking frame (113) with a base plate, and a perforated and cylindrical hollow inner core (109), which is erected perpendicularly near a center of the base plate of the vertical strut-based canister docking frame (113). Preferably, as shown in FIG. 1, FIG. 3, and FIG. 4, the perforated hollow cylindrical inner core (i.e. 109, 303A, 303B, 403A, 403B) incorporates a plurality of micro-holes on its lateral surface.

Furthermore, the reusable filter canister (100) also includes one or more vertical struts (111A, 111B), which are erected perpendicularly from a boundary of the base plate of the vertical strut-based canister docking frame (113). In the preferred embodiment, four vertical struts (e.g. 405A, 405B, 405C, 405D in FIG. 4) may be utilized in the structure of the vertical strut-based canister docking frame (113). In another embodiment, more or less number of vertical struts may be utilized, depending on the design and the load requirements of a particular dry-cleaning machine. For instance, a higher-capacity reusable filter canister may be designed and manufactured with a higher number of vertical struts to withstand increased weight, tension, and stress levels to hold the higher-capacity reusable filter canister together, while a lower-capacity reusable filter canister may be designed and manufactured with a lower number of vertical struts, as the lower number of vertical struts may be sufficient to satisfy desired weight, tension, and stress level requirements of the lower-capacity reusable filter canister.

Figure 5:
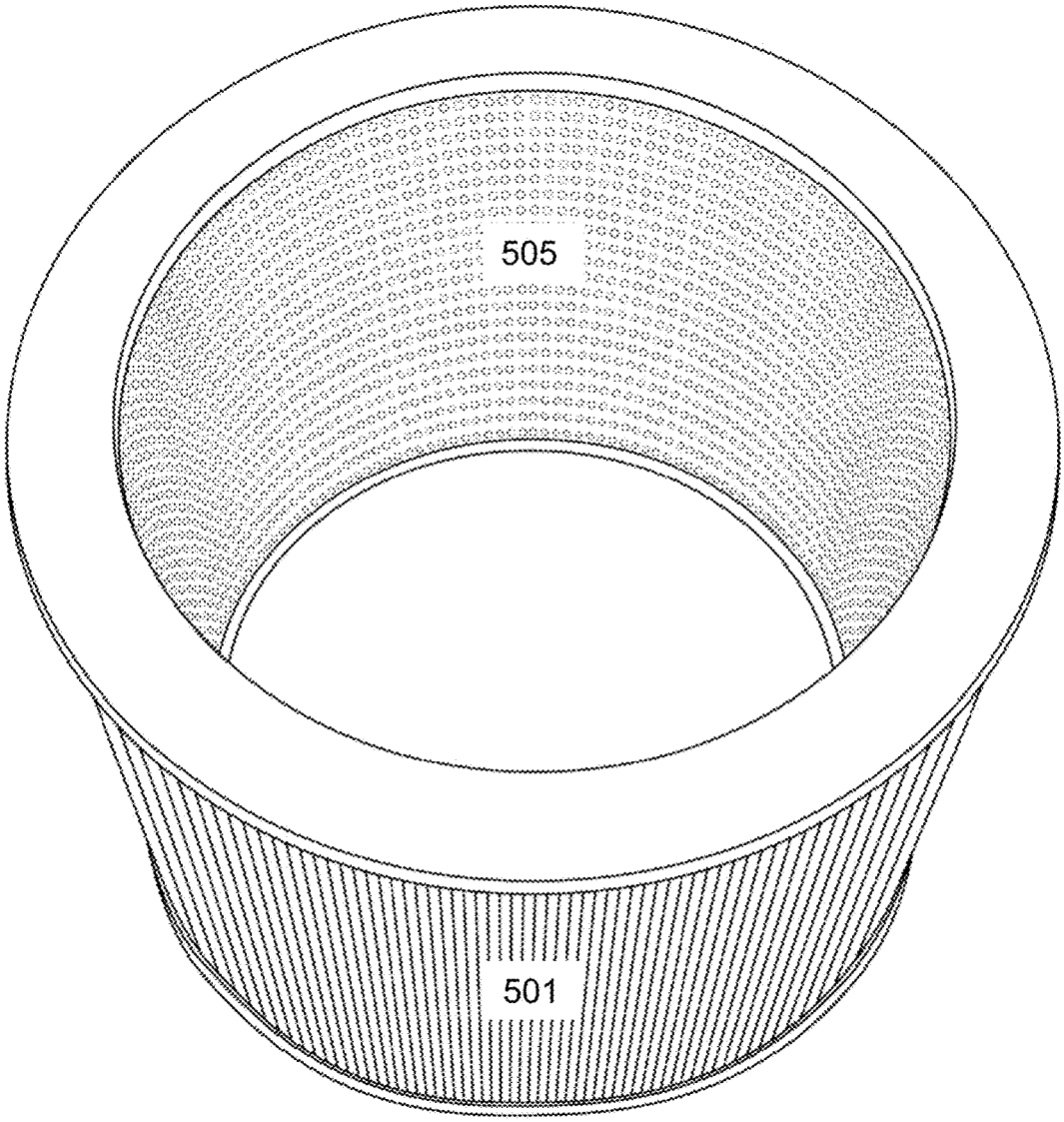
FIG. 5 shows a perspective view of a washable and reusable cartridge with a perforated rigid inner surface layer and a particulate filtering element-encapsulating outer surface layer configured to dock into a reusable filter canister for a dry-cleaning machine, in accordance with an embodiment of the invention.

Moreover, in the preferred embodiment, the reusable filter canister (100) also includes a washable and reusable cylindrical cartridge (i.e. 500 in FIG. 5) comprising a perforated rigid inner surface layer (i.e. 505 in FIG. 5) and a particulate filtering element-encapsulating outer surface layer (i.e. 107 in FIG. 1 or 501 in FIG. 5), as shown in FIG. 1 and FIG. 5. The washable and reusable cylindrical cartridge (i.e. 500 in FIG. 5) is configured to be docked into or removed from the vertical strut-based canister docking frame (113) with the base plate. Preferably, as shown in FIG. 1 and FIG. 3, a bottom outer boundary of the washable and reusable cylindrical cartridge (i.e. 107, 301), when docked into the vertical strut-based canister docking frame (i.e. 113, 313), is enclosed by the base plate of the vertical strut-based canister docking frame (i.e. 113, 313).

In addition, the reusable filter canister (100) also includes a removable lid (101) with a center opening that aligns with a top portion of the perforated and cylindrical hollow inner core (109). As shown in FIG. 1, the removable lid (101) is configured to enclose a top outer boundary of the washable and reusable cylindrical cartridge (i.e. 500 in FIG. 5). As shown in FIG. 1, a lid clamp (e.g. 103A, 103B, 103C, or 103D) is attached to a top portion of the vertical strut (e.g. 111A, 111B, etc.), and is configured to bind the vertical strut-based canister docking frame (e.g. 113 in FIG. 1, 313 in FIG. 3, 400 in FIG. 4, etc.), the washable and reusable cylindrical cartridge (107, 500 in FIG. 5, etc.), and the removable lid (101) tightly as a clamp, when the washable and reusable cylindrical cartridge (e.g. 500 in FIG. 5) is docked into the vertical strut-based canister docking frame (e.g. 113 in FIG. 1, 313 in FIG. 3, 400 in FIG. 4, etc.).

Furthermore, in one embodiment of the invention, the removable lid (101) may incorporate a reusable filter canister handle (105) for the ease of portability when removing or transporting the reusable filter canister (100) from a corresponding dry-cleaning machine. In particular, the reusable filter canister handle (105) allows a dry-cleaning machine operator to carry the reusable filter canister (100) easily for routine debris and residue removal and cleaning activities.

Historically, conventional commercial-grade dry-cleaning filters are replaceable "black box" units manufactured and marketed by dry-cleaning machine manufacturers. Due to various difficulties involving maintenance and safety issues, the conventional commercial-grade dry-cleaning filters are not meant to be opened up, washable, and/or reusable by a commercial dry-cleaning operator. Instead, the commercial dry-cleaning operator regularly purchases the "black box" dry-cleaning filter canisters and simply dispose and replace the old canisters periodically, despite high costs associated with one time-use canister replacements and negative environmental impact.

A key novel aspect of an embodiment of the present invention is derived from the structure of the perforated and cylindrical hollow inner core (109 in FIG. 1, 303A and 303B in FIG. 3, 403A and 403B in FIG. 4), which is illustrated, for example, in FIGS. 1, 3, and 4. The perforated and cylindrical hollow inner core (109), which is part of the vertical strut-based canister docking frame (e.g. 113 in FIG. 1, 400 in FIG. 4) structure, comprises an inner perforated cylindrical surface (e.g. 303B in FIG. 3, 403B in FIG. 4) and an outer perforated cylindrical surface (e.g. 303A in FIG. 3, 403A in FIG. 4), wherein the inner and the outer perforated cylindrical surface form a hollow inner cylindrical core. This hollow inner cylindrical core prevents or reduces debris overfill and jamming by maintaining a debris-free column of airspace within the perforated and cylindrical hollow inner core (109), while directing debris and chemical residue to be deposited and contained between the outer perforated cylindrical surface (e.g. 303A in FIG. 3) and the perforated rigid inner surface layer (e.g. 305 in FIG. 3, 505 in FIG. 5) of the washable and reusable cartridge (e.g. 500 in FIG. 5), even after numerous and strenuous commercial-capacity dry-cleaning cycle operations.

Without the debris-free column of airspace within the perforated and cylindrical hollow inner core (109), the entire inner space of the reusable filter canister (100) would otherwise be jampacked with debris and chemical residues, which create a tremendous radially-outward expansion pressure on the inner walls of the canister. The tremendous radially-outward expansion pressure in a conventional filter canister often makes a canister lid opening difficult for dry cleaning operators, as the conventional filter canister made of metallic or plastic materials often succumbs to the radially-outward pressure and correspondingly expands its circumference contacting the canister lid, thus making the canister lid nearly impossible to remove from the conventional filter canister.

Furthermore, the high-density residue and debris packed inside the conventional filter canister (i.e. without the novel debris-free column of airspace within the filter canister) also become difficult to remove from the filter canister itself. In contrast, the novel debris-free column of airspace created by the perforated and cylindrical hollow inner core (109), as embodied in the reusable filter canister (100) of the present invention, ensures debris-free airspaces near the center of the circumference within the filter canister structure, which in turn enables easier power washing, dusting, and/or removal of residue and debris buildup inside the filter canister. In addition, the uniquely micro hole-perforated surfaces (e.g. 303A and 303B in FIG. 3, and 403A and 403B in FIG. 4) of the hollow inner cylindrical core enable a good airflow through the reusable filter canister (100) during dry-cleaning machine operation cycles, while preventing sizable debris and chemical residue from entering into the perforated and cylindrical hollow inner core (109).

Figure 2:
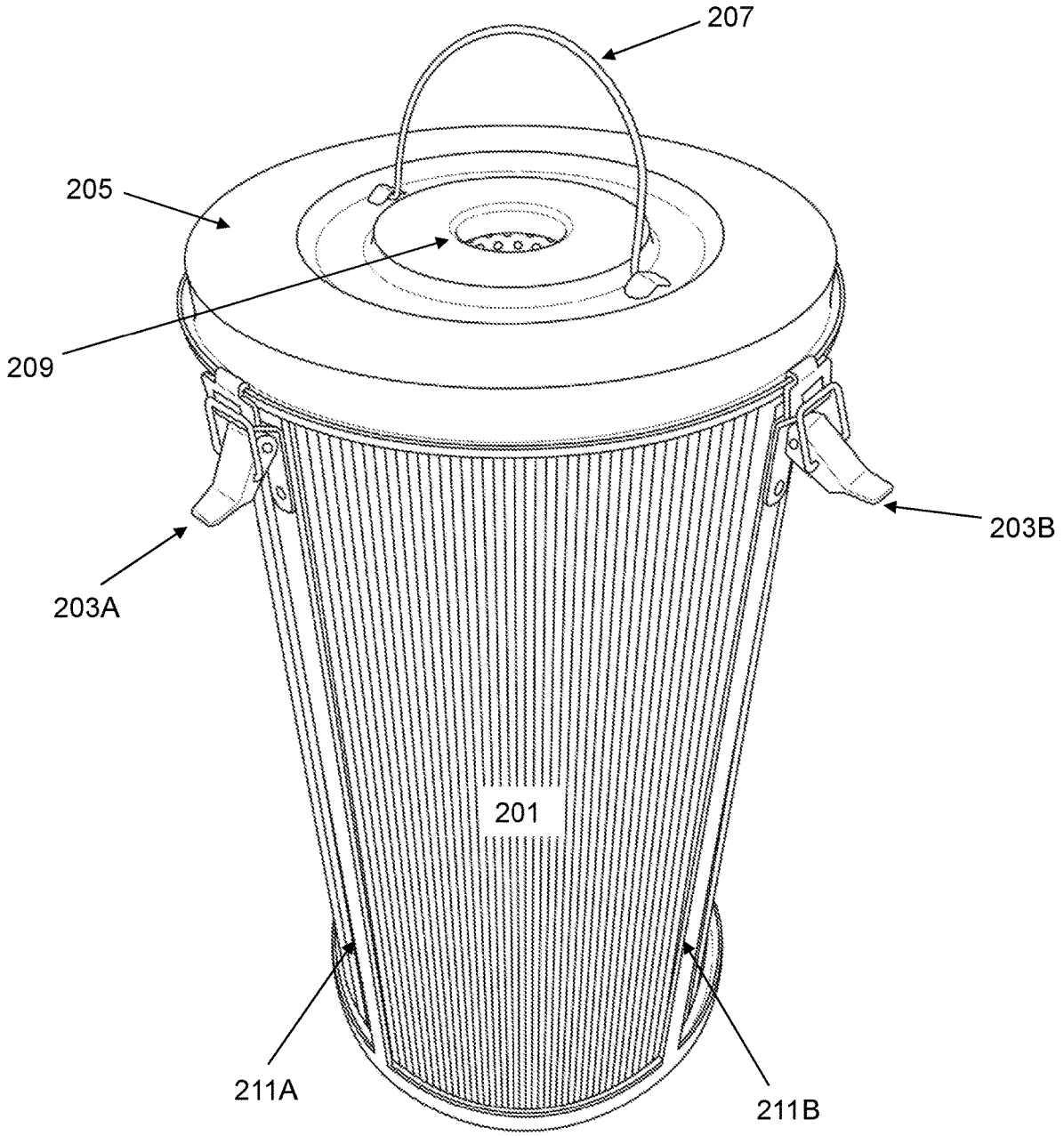
FIG. 2 shows a frontal perspective view of another embodiment of a reusable filter canister for a dry-cleaning machine, in accordance with an embodiment of the invention.

FIG. 2 shows a frontal perspective view of an elongated embodiment of a reusable filter canister (200) for a dry-cleaning machine, in accordance with an embodiment of the invention. This second (i.e. elongated) embodiment of the reusable filter canister (200) has an elongated height and a smaller canister circumference, but retains similar or identical structures embodied by the first embodiment of the reusable filter canister (100) previously described in conjunction with FIG. 1. As shown in FIG. 2, the elongated reusable filter canister (200) is made of a vertical strut-based canister docking frame with a base plate, and a perforated and cylindrical hollow inner core (209), which is erected perpendicularly near a center of the base plate of the vertical strut-based canister docking frame. Preferably, as shown in FIG. 3 and FIG. 4, the perforated hollow cylindrical inner core (i.e. 209, 303A, 303B, 403A, 403B) incorporates a plurality of micro-holes on its lateral surface.

Furthermore, the elongated reusable filter canister (200) also includes one or more vertical struts (211A, 211B), which are erected perpendicularly from a boundary of the base plate of the vertical strut-based canister docking frame. In the preferred embodiment, four vertical struts (e.g. 405A, 405B, 405C, 405D in FIG. 4) may be utilized in the structure of the vertical strut-based canister docking frame. In another embodiment, more or less number of vertical struts may be utilized, depending on the design and the load requirements of a particular dry-cleaning machine. For instance, a higher-capacity reusable filter canister may be designed and manufactured with a higher number of vertical struts to withstand increased weight, tension, and stress levels to hold the higher-capacity reusable filter canister together, while a lower-capacity reusable filter canister may be designed and manufactured with a lower number of vertical struts, as the lower number of vertical struts may be sufficient to satisfy desired weight, tension, and stress level requirements of the lower-capacity reusable filter canister.

Moreover, in the preferred embodiment, the elongated reusable filter canister (200) also includes a washable and reusable cylindrical cartridge (i.e. 500 in FIG. 5) comprising a perforated rigid inner surface layer (i.e. 505 in FIG. 5) and a particulate filtering element-encapsulating outer surface layer (i.e. 201 in FIG. 2 or 501 in FIG. 5), as shown in FIG. 2 and FIG. 5. The washable and reusable cylindrical cartridge (i.e. 500 in FIG. 5) is configured to be docked into or removed from the vertical strut-based canister docking frame with the base plate. Preferably, a bottom outer boundary of the washable and reusable cylindrical cartridge (i.e. the lower portion of 201), when docked into the vertical strut-based canister docking frame (e.g. 400 in FIG. 4), is enclosed by the base plate (e.g. 401 in FIG. 4) of the vertical strut-based canister docking frame.

In addition, the elongated reusable filter canister (200) also includes a removable lid (205) with a center opening that aligns with a top portion of the perforated and cylindrical hollow inner core (209). As shown in FIG. 2, the removable lid (205) is configured to enclose a top outer boundary of the washable and reusable cylindrical cartridge (i.e. 500 in FIG. 5). As shown in FIG. 2, a lid clamp (e.g. 203A, 203B) is attached to a top portion of the vertical strut (e.g. 211A, 211B, etc.), and is configured to bind the vertical strut-based canister docking frame (e.g. 113 in FIG. 1, 313 in FIG. 3, 400 in FIG. 4, etc.), the washable and reusable cylindrical cartridge (207, 500 in FIG. 5, etc.), and the removable lid (205) tightly as a clamp, when the washable and reusable cylindrical cartridge (e.g. 500 in FIG. 5) is docked into the vertical strut-based canister docking frame (e.g. 113 in FIG. 1, 313 in FIG. 3, 400 in FIG. 4, etc.).

Furthermore, in one embodiment of the invention, the removable lid (205) may incorporate a reusable filter canister handle (207) for the ease of portability when removing or transporting the elongated reusable filter canister (200) from a corresponding dry-cleaning machine. In particular, the reusable filter canister handle (205) allows a dry-cleaning machine operator to carry the elongated reusable filter canister (200) easily for routine debris and residue removal and cleaning activities.

FIG. 3 shows an open-lid top perspective view (300) of an embodiment of a reusable filter canister for a dry-cleaning machine, in accordance with an embodiment of the invention. As illustrated in this open-lid top perspective view (300), when the removable top lid for the reusable filter canister is removed, the reusable filter canister comprises a vertical strut-based canister docking frame (313), one or more vertical struts (309) melded or attached to the vertical strut-based canister docking frame, one or more lid clamps (311A, 311B, 311C, 311D) located on top of each vertical strut (309), and a perforated and cylindrical hollow inner core (303A, 303B) comprising a perforated hollow inner core interior surface (303B) and a perforated hollow inner core exterior surface (303A).

Furthermore, the reusable filter canister also incorporates a washable and reusable cartridge with a particulate filtering element-encapsulating outer surface layer (301), which is kept in a stationary position by a removable upper lid frame (307), as shown in FIG. 3. Preferably, the removable upper lid frame (307) is configured to maintain a fixed positioning of the washable and reusable cartridge within the reusable filter canister structure, once the removable lid (e.g. 101 in FIG. 1) is placed on top of the removable upper lid frame (307) and secured with the one or more lid clamps (311A, 311B, 311C, 311D) located on top of the corresponding vertical struts (309). In one embodiment of the invention, the vertical strut-based canister docking frame (313), one or more vertical struts (309), one or more lid clamps (311A, 311B, 311C, 311D) located on top of each vertical strut (309), the removable upper lid frame (307), and the removable lid are made of aluminum, stainless steel, rubber, plastic, or composite materials combining metallic, rubber, and/or plastic elements.

FIG. 4 shows a perspective view of a vertical strut-based canister docking frame (400) with a base plate (401), a perforated hollow inner core (403A, 403B), a plurality of vertical struts (405A, 405B, 405C, 405D), and a plurality of lid clamps (407A, 407B, 407C, 407D) attached to the plurality of vertical struts as part of a reusable filter canister structure for a dry-cleaning machine, in accordance with an embodiment of the invention. In a preferred embodiment of the invention, the perspective view of the vertical strut-based canister docking frame (400) appears when a washable and reusable cartridge (e.g. 500 in FIG. 5), a removable upper lid frame (e.g. 307 in FIG. 3), and a removable lid (e.g. 101 in FIG. 1) are removed from the completely-assembled reusable filter canister structure, as previously illustrated in FIG. 1 and FIG. 2.

The washable and reusable cartridge (e.g. 500 in FIG. 5) and the vertical strut-based canister docking frame (400) with the base plate (401), when disassembled by loosening the lid clamps (407A, 407B, 407C, 407D) and removing the removable lid (e.g. 101 in FIG. 1), can be dusted off or power-washed separately, and then reassembled for an environmentally-friendly reuse in subsequent dry-cleaning operating cycles, instead of discarding and replacing the particulate filtering element (e.g. 107) in the washable and reusable cartridge or any other components.

The novel structure of the perforated and cylindrical hollow inner core (403A and 403B) comprises an inner perforated cylindrical surface (403B) and an outer perforated cylindrical surface (403A), wherein the inner and the outer perforated cylindrical surface form a hollow inner cylindrical core. This hollow inner cylindrical core prevents or reduces debris overfill and jamming by maintaining a debris-free column of airspace within the perforated and cylindrical hollow inner core (403A and 403B), while directing debris and chemical residue to be deposited and contained between the outer perforated cylindrical surface (e.g. 303A in FIG. 3) and the perforated rigid inner surface layer (e.g. 305 in FIG. 3, 505 in FIG. 5) of the washable and reusable cartridge (e.g. 500 in FIG. 5), even after numerous and strenuous commercial-capacity dry-cleaning cycle operations.

Without the debris-free column of airspace within the perforated and cylindrical hollow inner core (403A and 403B), the entire inner space of the reusable filter canister would otherwise be jampacked with debris and chemical residues, which create a tremendous radially-outward expansion pressure on the inner walls of the canister. This radially-outward expansion pressure in a conventional filter canister often makes a canister lid opening difficult for dry cleaning operators, as the conventional filter canister made of metallic or plastic materials often succumbs to the radially-outward pressure and correspondingly expands its circumference contacting the canister lid, thus making the canister lid nearly impossible to remove from the conventional filter canister.

Furthermore, the high-density residue and debris packed inside the conventional filter canister (i.e. without the novel debris-free column of airspace within the filter canister) also become difficult to remove from the filter canister itself. In contrast, the novel debris-free column of airspace created by the perforated and cylindrical hollow inner core (403A and 403B), as embodied in the reusable filter canister of the present invention, ensures debris-free airspaces near the center of the circumference within the filter canister structure, which in turn enables easier power washing, dusting, and/or removal of residue and debris buildup inside the filter canister. In addition, the uniquely micro hole-perforated surfaces of the hollow inner cylindrical core enable a good airflow through the reusable filter canister during dry-cleaning machine operation cycles, while preventing sizable debris and chemical residue from entering into the perforated and cylindrical hollow inner core (403A and 403B).

FIG. 5 shows a perspective view of a washable and reusable cartridge (500) with a perforated rigid inner surface layer (505) and a particulate filtering element-encapsulating outer surface layer (501) configured to dock into a reusable filter canister for a dry-cleaning machine, in accordance with an embodiment of the invention. In one embodiment of the invention, the particulate filtering element-encapsulating outer surface layer (501) is made of paper, synthetic fabric, carbon compounds, metallic mesh screens, or a combination thereof to capture debris and other impurities during the dry-cleaning machine operation cycles.

As described previously, advantages of the novel reusable filter canister structure and related features are numerous. For example, unlike conventional disposable and onetime-use dry-cleaning machine filter cartridges manufactured and marketed by the dry cleaning machine manufacturer, the novel reusable filter canister, devised in accordance with an embodiment of the invention, can be repeatedly dusted out to a trash container and/or cleaned with a power wash for a prolonged operational lifecycle. Furthermore, the novel reusable filter canister incorporates a uniquely-structured perforated and cylindrical hollow inner core in a vertical strut-based canister docking frame that provides a debris-free air column near the center of the canister to prevent or reduce debris and chemical residue overfill or jampacking in the canister, while also maintaining airflow breathability within the canister via perforated inner core surfaces to improve filter durability and alleviate disassembly and cleaning difficulties for a dry-cleaning operator.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A reusable filter canister for a dry-cleaning machine comprising:

a vertical strut-based canister docking frame with a base plate and a vertical strut structured as a single-piece frame without detachability between the base plate and the vertical strut, wherein the vertical strut erects perpendicularly from a boundary of the base plate of the vertical strut-base canister docking frame;

a perforated and cylindrical hollow inner core erected perpendicularly from a center of the base plate of the vertical strut-based canister docking frame, wherein the perforated hollow cylindrical inner core incorporates a plurality of micro-holes on its lateral surface;

a washable and reusable cylindrical cartridge comprising a perforated rigid inner surface layer and a particulate filtering element-encapsulating outer surface layer, wherein the washable and reusable cylindrical cartridge is configured to be docked into or removed from the vertical strut-based canister docking frame with the base plate, wherein a bottom outer boundary of the washable and reusable cylindrical cartridge, when docked into the vertical strut-based canister docking frame, is enclosed by the base plate;

a removable lid with a center opening that aligns with a top portion of the perforated and cylindrical hollow inner core, wherein the removable lid is configured to enclose a top outer boundary of the washable and reusable cylindrical cartridge; and a lid clamp formed on a tip of the vertical strut as part of the single-piece frame without detachability among the base plate, the vertical strut, and the lid clamp, wherein the lid clamp is configured to bind the vertical strut-based canister docking frame, the washable and reusable cylindrical cartridge, and the removable lid tightly when the washable and reusable cylindrical cartridge is docked into the vertical strut-based canister docking frame.

2. The reusable filter canister of claim 1, further comprising a removable upper lid frame placed above the top outer boundary of the washable and reusable cylindrical cartridge and below the removable lid.

3. The reusable filter canister of claim 1, further comprising a reusable filter canister handle attached to the removable lid, wherein the reusable filter canister handle allows a dry-cleaning machine operator to carry the reusable filter canister easily for routine debris and residue removal and cleaning activities.

4. The reusable filter canister of claim 1, wherein the perforated and cylindrical hollow inner core prevents or reduces debris overfill and jamming by maintaining a debris-free column of airspace within the perforated and cylindrical hollow inner core, while directing debris and chemical residue to be contained between an outer surface of the perforated and cylindrical hollow inner core and the perforated rigid inner surface layer of the washable and reusable cartridge, even after a prolonged dry-cleaning operation.

5. The reusable filter canister of claim 1, wherein the particulate filtering element in the washable and reusable cartridge is a paper filter, a synthetic fabric filter, a carbon filter, a metallic mesh filter, or a combination thereof.

6. The reusable filter canister of claim 1, wherein the vertical strut-based canister docking frame with the base plate, the vertical strut, and the removable lid are made of aluminum, stainless steel, rubber, plastic, or a combination thereof.

7. The reusable filter canister of claim 1, wherein the washable and reusable cylindrical cartridge and the vertical strut-based canister docking frame with the base plate, when disassembled by loosening the lid clamp and removing the removable lid, are configured to be dusted off or power-washed separately.

* * * * *